United States Patent [19]

Zerhoch et al.

[11] 4,152,913

[45] May 8, 1979

[54] STRAIGHTENING MACHINE FOR STRAIGHTENING SHEET METAL AND FLAT MATERIALS

[75] Inventors: Horst Zerhoch, Sinzheim; Karl Vohringer, Malsch, both of Fed. Rep. of Germany

[73] Assignee: Horst Zerhoch Vörrichtungs und maschinenbau GmbH & Co. KG, Sinzheim, Fed. Rep. of Germany

[21] Appl. No.: 862,528

[22] Filed: Dec. 20, 1977

[30] Foreign Application Priority Data

Dec. 21, 1976 [DE] Fed. Rep. of Germany ..... 2657876

[51] Int. Cl.[2] ..... B21D 1/02

[52] U.S. Cl. ..... 72/20; 72/165

[58] Field of Search ..... 72/165, 164, 163, 160, 72/8, 19, 20

[56] References Cited

U.S. PATENT DOCUMENTS

| | | | |
|---|---|---|---|
| 2,944,585 | 7/1960 | Ungerer | 72/165 |
| 3,031,009 | 4/1962 | Muddiman | 72/165 |

FOREIGN PATENT DOCUMENTS 1452867 4/1972 Fed. Rep. of Germany.

*Primary Examiner*—Milton S. Mehr

*Attorney, Agent, or Firm*—Stevens, Davis, Miller & Mosher

[57] ABSTRACT

A material straightening machine is provided with upper and lower roller frames and at least two piston assemblies interconnecting the frames and located respectively at the inlet and outlet sides of the roller frames. Each piston assembly includes a chamber housing a piston, the chamber being further divided by the piston into an upper annular chamber and a lower annular chamber. The upper annular chamber is connected directly to a pressure medium source while the lower annular chamber, which has a cross sectional area which differs from that of the upper annular chamber, is connected to the pressure medium source through a servo-controlled pressure reducing valve. Relative movement between the frames is effected by controlling the pressure reducing valve.

13 Claims, 1 Drawing Figure

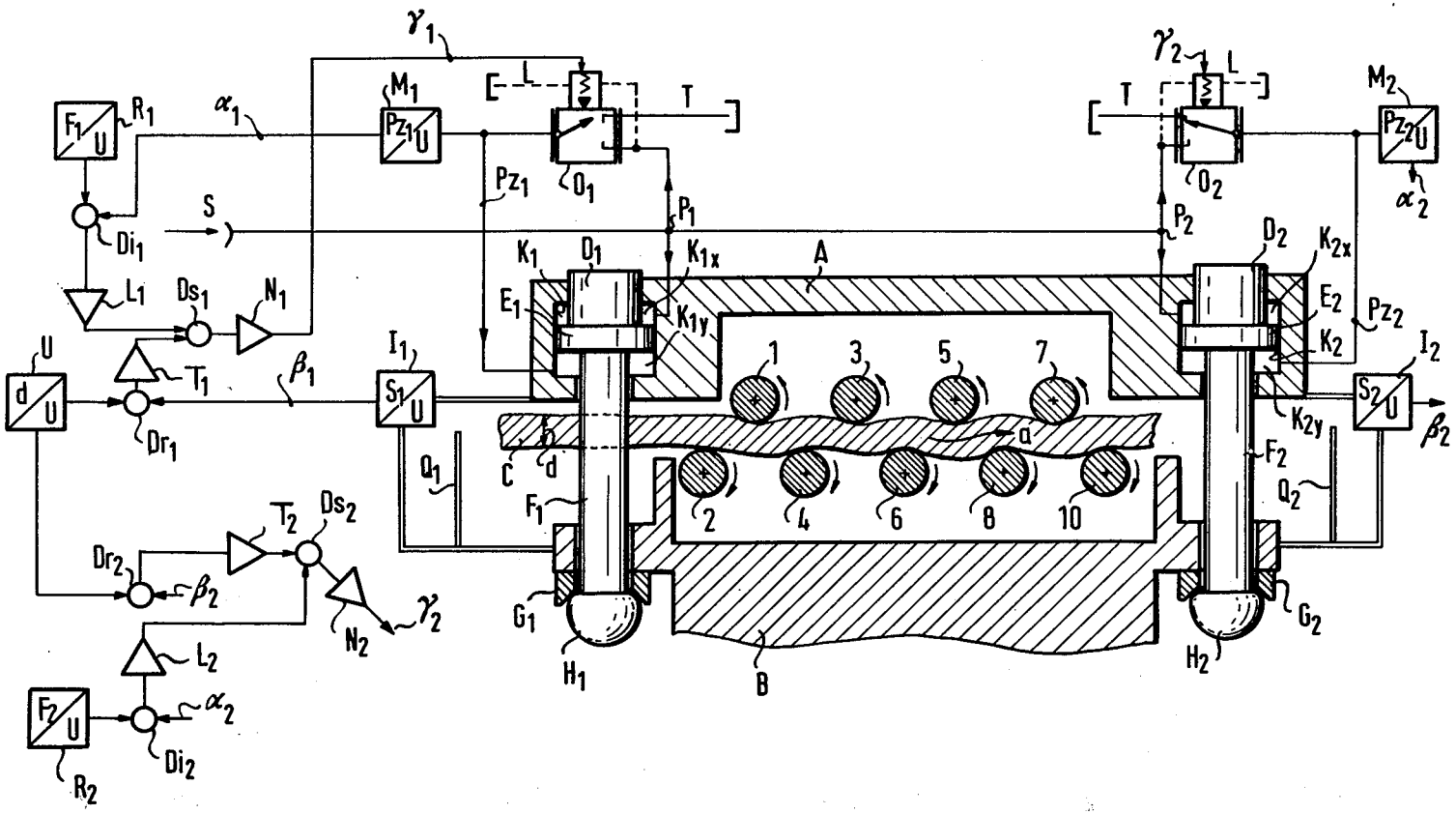
A
B
C
D
S
U
1
2
3
4
5
6
7
8
10
$M_1$
$M_2$
$Pz_1$
$Pz_2$
$O_1$
$O_2$
$P_1$
$P_2$
$K_1$
$K_2$
$K_{1x}$
$K_{1y}$
$K_{2x}$
$K_{2y}$
$E_1$
$E_2$
$D_1$
$D_2$
$F_1$
$F_2$
$G_1$
$G_2$
$H_1$
$H_2$
$Q_1$
$Q_2$
$I_1$
$I_2$
$Sr_1$
$Sr_2$
$N_1$
$N_2$
$T_1$
$T_2$
$L_1$
$L_2$
$R_1$
$R_2$
$Ds_1$
$Ds_2$
$Dr_1$
$Dr_2$
$Di_1$
$Di_2$
$\alpha_1$
$\alpha_2$
$\beta_1$
$\beta_2$
$\gamma_1$
$\gamma_2$

STRAIGHTENING MACHINE FOR STRAIGHTENING SHEET METAL AND FLAT MATERIALS

BRIEF SUMMARY OF THE INVENTION

The present invention relates to a straightening machine for straightening sheet metal and flat material which has a lower and an upper roller frame each respectively accommodating lower and upper forcibly-driven straightening rollers. The rollers for each frame are spaced from each other and positioned transverse to the direction of material flow with the straightening rollers of the upper roller frame being arranged in the interstices between those of the lower roller frame.

In this type of straightening machine, the spatial relationship between the upper and the lower roller frames, i.e., the setting of the straightening gap between the straightening rollers, is usually effected, for example, via spindles operated by means of a hand wheel, with the setting values being monitored by measurement gauges or similar mechanical measuring devices. However, the setting of these straightening machines is relatively complicated and is effected rigidly, without any possibility of flexible adaptation to the different properties of the material flowing therethrough.

Therefore, one object of this invention is to provide an improved straightening machine of the above-mentioned design wherein the machine may be easily and automatically set to desired parameters.

Another object of the invention is to provide a straightening machine which can be set remotely.

Another object of the invention is to provide a straightening machine which dispenses with complex intermediate controls and precise measurements and which does not need re-adjustment for small deviations in the material flowing therethrough.

Finally, another object of the invention is to provide a straightening machine which needs no re-adjustments or measurements for differing batches of material which flow therethrough.

These and other objects are achieved by connecting together the upper and lower roller frames in a force-locked manner with a hydraulic driving assembly including at least one pair of pistons, preferably thrust pistons, which reciprocate in respective cylinder chambers. Each piston has two different effective cross sections for controlling relative movement between the upper and lower frames, as described further below.

In order to obtain a greater amount of freedom of relative adjustment between the upper and the lower roller frames to compensate for deviations in the material to be straightened, particularly between the inlet and outlet of the straightening machine, a preferred embodiment provides for the hydraulic driving assembly to include two pairs of displaceable pistons, one pair at the inlet and one at the outlet of the straightening machine. The chambers and pistons of the hydraulic driving assembly are located in one of the roller frames (e.g., the upper roller frame), while the lower free ends of the pistons are coupled via piston rods to a ball joint coupling located in the other roller frame (e.g., the lower roller frame).

The cylinder chambers which guide respective pistons are each divided by the piston into two annular chambers of different effective cross-section areas. These different effective cross-section areas can be obtained, for example, by providing each piston with upper and lower piston rods having different diameters. For example, the lower piston rod nearest to the lower roller frame can have a smaller diameter than the upper piston rod. With this construction, if the same pressure exists in the pressure medium disposed in the annular chamber above the piston and below the piston, the piston and associated piston rods are drawn upwards due to the greater effective cross-sectional area of the lower annular chamber, thereby effecting the relative positioning between the upper and lower roller frames.

With the positioning system as above described, adjustment of the relative positions of the upper and lower roller frames can only be effected by an appropriate alteration in the pressure of the pressure medium source. Moreover, a straigthening machine so constructed would always have the same relative positioning forces prevail at the inlet and outlet of the material straightening machine, which is particularly undesirable when the machine is to be adjusted for variations in material thickness. In actual fact, the straightening of many flat materials with machines of this kind is similar to a cold-rolling process wherein a slight reduction in thickness occurs. For this reason an independently controlled adjustment of the pressure in one of the annular chambers of each cylinder chamber relative to the pressure in the other annular chamber is desirable.

A particularly preferred embodiment of the invention provides for independent controlled adjustment of individual cylinder pressures by using a servo controlled pressure-reducing valve. This valve converts a continuously adjustable electrical value, preset via a control circuit, into a continuously adjustable reduced pressure value. Separate servo controlled pressure-reducing valves can be provided for each pair of thrust pistons, for example, one for the pair of thrust pistons at the inlet and one for the pair of thrust pistons at the outlet of the straightening machine, so that two additively or subtractively connected control circuits are provided for adjusting the relative pressure at the inlet or outlet. Even greater flexibility can be achieved if each thrust piston assembly is provided with its own servo controlled pressure-reducing valve with an appropriate control circuit, so that there are, for example, four interconnected control circuits.

As a further refinement, the control system for the straightening machine may further include a subordinate regulator via which a desired material thickness value and thus the actual amount of dimensional reduction, can be set for a specific material to be straightened. Since certain kinds of straightening machines also have a minimum value for the thickness of material which can be treated, a stop is provided for defining the lower limit to which the desired value can be set. This stop becomes operative when the desired value set in the system lies below the lower limit of material thickness; that is, when the actual value of material thickness exceeds the lower dimension for the thickness of the material which can be treated by the machine.

Additional objects, advantages, and features of the invention will be evident from the ensuing discussion wherein particular reference is made to the sole FIGURE of Drawing, which, by way of example, shows one embodiment thereof.

BRIEF DESCRIPTION OF THE DRAWING

The sole FIGURE shows schematically the interconnection of an upper and lower roller frame of a straightening machine which is equipped with an automatic relative position adjustment system according to the invention.

DETAILED DESCRIPTION OF THE INVENTION

As can be seen from the sole FIGURE, a straightening machine is provided with an upper roller frame A with forcibly driven straightening rollers 1, 3, 5, 7 . . . and a lower roller frame B with lower straightening rollers 2, 4, 6, 8, 10 . . . the latter set of rollers being arranged in the interstices between the straightening rollers of the upper roller frame. The construction of the two roller frames and the drive, bracing, mounting and arrangement of the straightening rollers, etc. are not the subject of the invention, with the exception of the connecting and adjusting elements which couple together the upper and the lower roller frame and the operating and regulating elements associated with these relative adjustment elements.

The gap between the straightening rollers 1, 3, 5, 7 . . . of the upper foller frame and the straightening rollers 2, 4, 6, 8, 10 . . . of the lower roller frame can be adjusted to the material thickness d of the material to be straightened C which is passed between these rows of rollers in the direction of the arrow a, in a manner which is described in more detail below.

As noted above, the relative adjustment between the upper and the lower roller frames is preferably carried out by means of a total of four pistons, arranged in two pairs, one at the material inlet for the straightening machine and one at the material outlet; however, other numbers of pistons can also be used. Since the figure schematically illustrates a four piston machine in longitudinal section, only one piston of each pair is shown, namely, piston $E_1$ at the material inlet and piston $E_2$ at the material outlet. All pistons are preferably thrust pistons.

The piston rods $F_1$ and $F_2$ project into associated cylinder chambers $K_1$ and $K_2$, respectively, in the upper roller frame, and are rigidly connected to respective pistons $E_1$ and $E_2$ which can be reciprocally moved in respective cylinder chambers $K_1$ and $K_2$. The upper portions of pistons $E_1$ and $E_2$ respectively terminate at piston rod sections $D_1$ and $D_2$. The piston rods $F_1$ and $F_2$ and the piston rod sections $D_1$ and $D_2$ are passed in a leak-tight manner through the end walls of the cylinder chambers $K_1$ and $K_2$ respectively. Piston rods $F_1$ and $F_2$ respectively terminate in ball and socket arrangements $G_1$, $H_1$ and $G_2$, $H_2$ which are attached to the lower roller frame. This ball and socket mounting allows the straightening machine to deal with relative inclines between the upper and lower frames caused by uneven material flowing through the system.

As shown, the piston rods $F_1$ and $F_2$ have a smaller diameter than the upper sections $D_1$ and $D_2$ of the piston rods which are connected to the pistons $E_1$ and $E_2$ respectively. As a result, the annular chamber sections $K_{1y}$ and $K_{2y}$ which lie below respective pistons $E_1$ and $E_2$ in the cylinder chambers $K_1$ and $K_2$ provide a greater effective cross-sectional area at the movable pistons $E_1$ and $E_2$ for a pressure medium than do the annular chambers $K_{1x}$ and $K_{2x}$ which respectively lie above the pistons $E_1$ and $E_2$, due to the greater diameter of the respective piston rod parts $D_1$ and $D_2$. In other words, if the upper annular chambers $K_{1x}$ and $K_{1y}$ and the lower annular chambers $K_{1y}$ and $K_{2y}$ are loaded with pressure medium at the same pressure, then the pistons $E_1$ and $E_2$ move upwards in the cylinder chambers $K_1$ and $K_2$, thereby drawing up the lower roller frame B and forcing the upper roller frame A down.

The upper annular chambers $K_{1x}$ and $K_{2x}$ are supplied with pressure medium from an adjustable pressure medium source S via respective branching points $P_1$ and $P_2$. The lower annular chambers $K_{1y}$ and $K_{2y}$ on the other hand are loaded with the pressure medium from respective branching points $P_1$ and $P_2$ via respective servo controlled pressure-reducing valves $O_1$ and $O_2$. The output pressures from valves $O_1$ and $O_2$ are respectively illustrated as $Pz_1$ and $Pz_2$. These pressures are usually lower than the pressure at the points $P_1$ and $P_2$.

The construction of the servo controlled pressure valves $O_1$ and $O_2$ is according to a known design. These valves are able to convert an electrical signal value which can be continuously adjusted within certain limits, into a correspondingly continuously adjustable pressure value, particularly a reduced pressure value. Valves $O_1$ and $O_2$ are connected to a return flow tank via an evacuation line, so that pressure medium which is to be evacuated from the lower annular chambers $K_{1y}$ and $K_{2y}$ can reach the return flow tank T directly. An unavoidable leakage loss is also shown with dotted lines and the reference L.

Pressure measuring cells $M_1$ and $M_2$ are respectively connected on the output sides of the servo controlled pressure-reducing valves $O_1$ and $O_2$ which correspond to the reduced pressures $Pz_1$ and $Pz_2$. These cells convert the pressure prevailing on the lower face of the pistons $E_1$ and $E_2$ to a corresponding value $\alpha_1$ and $\alpha_2$, which preferably is in the form of an electrical voltage. These values are supplied to respective difference forming elements $Di_1$ and $Di_2$, where they are compared with respective electrical signal values which correspond to a desired pressure setting which was previously set by adjustment elements $R_1$ and $R_2$, respectively. These adjustment elements may be adjustable digital potentiometers. The resulting comparative values are amplified by respective control amplifiers $L_1$ and $L_2$ each constituted, for example, by several separate cascade-connected amplifiers. The amplifier outputs are respectively supplied to other difference-forming elements $Ds_1$ and $Ds_2$, the function of which will be explained later, and from there to the inputs of respective output amplifiers $N_1$ and $N_2$ respectively. The outputs of these amplifiers respectively form the adjustment values $\gamma_1$ and $\gamma_2$, which respectively determine the adjustment of the servo controlled pressure-reducing valves $O_1$ and $O_2$. This completes the description of the control circuits for monitoring and controlling the pressure in the relevant lower annular chamber $K_{1y}$, $K_{2y}$ with respect to the pressure in a respective upper annular chamber $K_{1x}$, $K_{2x}$.

Although a pair of pressure control circuits utilizing a predetermined pressure setting has been described as respectively controlling an inlet pair and an outlet pair of pistons, it should be apparent that a two or more fold circuit construction can be used, e.g. a fourfold construction in which one circuit is provided for each piston.

All control circuits may in turn be subordinated to another common regulator U in which a preset value for a reduction of the thickness of the material can be set. Common regulator U may be embodied as a voltage value generator actuated by a digital potentiometer. Subordinated regulator U serves to adjust the machine to a desired reduction of thickness value; it does not, however, prevent the roller frames from moving apart as, for example, when the material to be straightened is being inserted.

To determine the value of the actual gap existing between the roller frames, actual gap value indicators $I_1$ and $I_2$ are provided which are connected mechanically, to the upper and lower roller frames. The actual gap value indicators $I_1$ and $I_2$ supply on their output sides analogue signals $\beta_1$ and $\beta_2$ respectively, which correspond to the actual value of the distance between the straightening rollers of the upper and lower roller frames at any given moment.

In order to obtain a comparison between the desired thickness value set in regulator U and the actual gap value, the output signal supplied by the subordinated regulator U and the respective output signal $\beta_1$ and $\beta_2$ of the actual value indicator $I_1$ and $I_2$ are supplied to respective difference-forming elements $Dr_1$ and $Dr_2$. The difference value obtained is amplified by respective amplifiers $T_1$ and $T_2$ and supplied as correction signals to the difference-forming elements $Ds_1$ and $Ds_2$, previously mentioned.

The thus described circuit centered around the subordinated regulator U thereof makes possible not only a controlled adjustment of the pressure and relative adjustment between the roller frames, but also a correction adjustment with regard to the gap between the straightening rollers of the upper and lower roller frames. Thus, fully automatic operation of the straightening machine is possible, since the relative positioning forces are monitored not only to a specific pressure, but also to a specific final straightened dimension.

The actual value indicators $I_1$ and $I_2$ have respective adjustable stop elements $Q_1$ and $Q_2$ arranged on their input and output sides by which the minimum sheet thicknesses which can be treated by a specific straightening machine is determined. If the straightening gap becomes so narrow that this minimum dimension is reached, then the upper frame indicator arm which is connected to the actual value indicator $I_1$ or $I_2$ runs up against the stop element $Q_1$ or $Q_2$ respectively, and restricts any further movement of the roller frames towards each other.

As can be appreciated from the foregoing discussion, the initial task of setting the straightening machine to desired parameters is easily accomplished by setting in valves with adjustable elements $R_1$ and $R_2$ without the need for monitoring of the machine and in particular without need for monitoring of measurement gauges as the machine is adjusted. In addition, all manual adjustment of the relative position of the roller frame has been eliminated. In the most preferred embodiment, by using a subordinated control circuit in which a preset material thickness is set, fully automatic operation is possible.

Although the invention has been described with reference to a most preferred embodiment, it should be apparent that the piston assembly has utility even without the described control circuits. Moreover, one or more servo controlled pressure-reducing valves can be used, as can one or more control circuits, depending on the desired degree of machine control. Therefore, the above description is to be regarded as merely exemplary and not limiting as these and other changes in form and detail may be made without departing from the spirit and scope of the invention, which is limited solely by the appended claims.

What is claimed is:

1. A material straightening apparatus comprising:

a material inlet and a material outlet defining a path of material flow;

an upper roller frame disposed between said inlet and outlet along said path, said upper roller frame housing a first plurality of forcibly driven parallel straightening rollers disposed along said path and transverse with respect thereto;

a lower roller frame disposed between said inlet and outlet along said path, said lower roller frame housing a second plurality of forcibly driven parallel straightening rollers disposed along said path and transverse with respect thereto, said second plurality of straightening rollers being arranged in the interstices between said first plurality of straightening rollers;

at least one pair of pressure medium operated piston assemblies for causing relative movement between said first and second frames and for locking said frames at predetermined relative positions, a first assembly of said pair of interconnecting said upper and lower frames in the vicinity of said inlet, and a second assembly of said pair interconnecting said upper and lower frames in the vicinity of said outlet, each of said piston assemblies comprising a cylinder chamber contained in one of said upper and lower frames, a piston reciprocating in said chamber which divides said chamber into an upper and lower annular chamber, said upper annular chamber of each piston assembly having a smaller effective cross-sectional area than a respective said lower annular chamber, a guide bore provided in said cylinder chamber, a piston rod having one end coupled to said piston and another end projecting through said guide bore and coupled to the other of said upper and lower frames, and means for directly connecting each of the upper annular chambers of said piston assemblies with an adjustable pressure medium source and each of said lower annular chambers of said piston assemblies to the output of a servo-controlled pressure reducing valve supplying a pressure medium from a source.

2. A material straightening apparatus as in claim 1 wherein a pair of said piston assemblies is provided in the vicinity of said inlet and a pair of said piston assemblies is provided in the vicinity of said outlet, each of said piston assemblies having its respective upper annular chamber connected directly to said pressure medium source, each piston assembly of said inlet pair having its lower annular chamber connected to the output of first servo controlled pressure reducing valve, and each piston assembly of said outlet pair having its lower annular chamber connected to the output of a second servo controlled pressure-reducing valve.

3. A material straightening apparatus as in claim 1 wherein said another end of said piston rod is coupled to said other of said upper and lower frames with a ball and socket coupling.

4. A material straightening apparatus of claim 2 further comprising a separate control circuit for each of said first and second servo controlled pressure-reducing valves, each of said control circuits comprising:

means for sensing the pressure of the pressure medium in the lower annular chamber of at least one of the respective pairs of piston assemblies associated with a servo controlled pressure-reducing valve, and for providing a first electrical signal representative of said sensed pressure;

means for setting a desired pressure level, and for forming a second electrical signal representative of said desired pressure;

first means for comparing said first and second electrical signals for providing a third electrical signal representing the difference between said desired and sensed pressure levels; and means for applying said third electrical signal to a control input of said associated servo controlled pressure-reducing valve.

5. A material straightening apparatus as in claim 4 wherein said means for setting for each control circuit is located remotely from said respective first and second servo controlled pressure-reducing valves.

6. A material straightening apparatus as in claim 5 wherein said means for setting for each control circuit can be set to a value different from the values set in the means for setting for the other control circuit.

7. A material straightening apparatus as in claim 4 further comprising a stop means for limiting relative movement of said upper and lower frames towards each other when a predetermined minimum gap distance between them is realized.

8. A material straightening apparatus as in claim 7 wherein said stop means comprises first and second adjustable stop devices positioned respectively in the vicinity of said inlet and outlet.

9. A material straightening apparatus as in claim 4 further comprising a regulator means commonly associated with said control circuits for pre-setting said control circuits with a desired value of material thickness.

10. A material straightening apparatus as in claim 9 wherein said regulator means comprises:

first means located in the vicinity of said inlet for measuring the actual value of the gap between said upper and lower frames and for forming a fourth electrical signal representing the actual value of the gap at said inlet;

second means located in the vicinity of said outlet for measuring the actual value of the gap between said upper and lower frames and for forming a fifth electrical signal representing the actual value of the gap at said output;

means for setting a desired gap value and for forming a sixth electrical signal representative of said desired gap value;

second comparison means for comparing said fourth and sixth electrical signals for providing a seventh electrical signal representing the difference between the actual gap at said inlet and said desired gap;

third comparison means for comparing said fifth and sixth electrical signals for providing an eighth electrical signal representing the difference between the actual gap of said outlet and said desired gap;

first means for combining said seventh electrical signal with said third electrical signal of one of said control circuits and for applying this combination to a control input of an associated one of said first and second servo controlled pressure-reducing valves; and second means for combining said eighth electrical signal with said third electrical signal of another of said control circuits and for applying this combination to a control input of an associated one of said first and second servo controlled pressure-reducing valves.

11. A material straightening apparatus as in claim 1 wherein a pair of said piston assemblies is provided in the vicinity of said inlet and a pair of said piston assemblies is provided in the vicinity of said outlet, each of said piston assemblies having its respective upper annular chamber connected to said pressure medium source and its lower annular chamber connected to the output of a respective servo controlled pressure-reducing values.

12. A material straightening apparatus as in claim 11 further comprising a separate control circuit for each of said servo controlled pressure-reducing valves, said control circuit comprising:

means for sensing the pressure of the pressure medium in a said lower annular chamber and for providing a first electrical signal representative of said sensed pressure;

means for setting a desired pressure level, and for forming a second electrical signal representative of said desired pressure;

first means for comparing said first and second electrical signals and for providing a third electrical representing the difference between said desired and sensed pressure levels; and means for applying said third electrical signal to a control input of a respective one of said servo controlled pressure-reducing valves.

13. A material straightening apparatus as in claim 1 wherein said piston assemblies are thrust operated.

* * * * *